US007222752B2

(12) United States Patent
Ponton

(10) Patent No.: US 7,222,752 B2
(45) Date of Patent: May 29, 2007

(54) DISPENSER DEVICE INCLUDING MEANS THAT ENABLE TWO SUBSTANCES TO BE DISPENSED IN VARYING PROPORTIONS

(75) Inventor: Thierry Ponton, Charenton le Pont (FR)

(73) Assignee: L'Oreal, Paris (FR)

( * ) Notice: Subject to any disclaimer, the term of this patent is extended or adjusted under 35 U.S.C. 154(b) by 448 days.

(21) Appl. No.: 10/730,044

(22) Filed: Dec. 9, 2003

(65) Prior Publication Data

US 2004/0251274 A1 Dec. 16, 2004

Related U.S. Application Data

(60) Provisional application No. 60/444,943, filed on Feb. 5, 2003.

(30) Foreign Application Priority Data

Dec. 20, 2002 (FR) ..... 02 16302

(51) Int. Cl.
*B67D 5/60* (2006.01)

(52) U.S. Cl. ..... 222/134; 222/137; 222/144.5

(58) Field of Classification Search ..... 222/134, 222/137, 309, 144.5
See application file for complete search history.

(56) References Cited

U.S. PATENT DOCUMENTS 4,006,841 A * 2/1977 Alticosalian ..... 222/42
4,432,469 A * 2/1984 Eble et al. ..... 222/134
5,423,752 A * 6/1995 Haber et al. ..... 222/137
5,779,109 A 7/1998 Gueret
5,971,210 A 10/1999 Brugger
6,464,107 B1 10/2002 Brugger
6,945,430 B2 * 9/2005 Bloc ..... 222/135
7,124,914 B2 * 10/2006 Foster et al. ..... 222/137
2001/0054626 A1 12/2001 Bethune et al.

FOREIGN PATENT DOCUMENTS

DE 31 22 330 A1 1/1983
DE 39 11 089 A1 10/1990
EP 0 427 609 B1 5/1991
EP 0 758 615 B1 2/1997
FR 2 733 800 11/1996
FR 2 793 479 11/2000

* cited by examiner

*Primary Examiner*—Philippe Derakshani
(74) *Attorney, Agent, or Firm*—Oliff & Berridge, PLC

(57) ABSTRACT

A dispenser device includes reservoirs for containing respective substances, pumps associated with respective reservoirs, and a pushbutton. The device allows two substances to be dispensed in varying proportions by actuating the pushbutton. In embodiments, each pump has a moving control member which, when actuated, causes the substance contained in the reservoir associated with the pump to be dispensed. In embodiments, at least one elastically-deformable transmission member is associated with a control member and is disposed in such a manner as to transmit displacement of the pushbutton to the control member in order to dispense substance. In embodiments, at least one adjustment member adjusts the end-of-stroke position of the displacement at least of the control member associated with the transmission member.

51 Claims, 3 Drawing Sheets

DISPENSER DEVICE INCLUDING MEANS THAT ENABLE TWO SUBSTANCES TO BE DISPENSED IN VARYING PROPORTIONS

This application claims the benefit of U.S. Provisional Application No. 60/444,943 filed on Feb. 5, 2003, the entire disclosure of which is incorporated by reference herein.

FIELD OF THE INVENTION

The present invention relates to dispenser devices that enable two or more substances to be dispensed in varying proportions.

BACKGROUND

European patent EP 758,615 describes an example of a device enabling a plurality of sunscreens of different indices or a sunscreen and an after-sun lotion, such as a moisturizing cream, to be made available in what appears to be a single package.

European patent application EP 427,609 describes a device including an adjustment member for varying the proportions in a mixture of two substances taken from respective reservoirs. The adjustment member is in the form of a rotary part that presses to a greater or lesser extent on a pump rod when a pushbutton is depressed. This device does not make it possible to dispense the substance contained in one or the other reservoir, for example, by a single adjustment member.

U.S. Pat. No. 5,971,210 describes a device that is relatively complex, having a mechanism that enables actuation of a pushbutton to be transformed into strokes of greater or shorter length for actuating pump rods.

The supplier Versadial of Marktoberdorf, Germany, also proposes a device having two pumps with control members that are actuated by a pivoting disk secured to the pushbutton and hinged at one end to an adjustment member capable of turning relative to a base portion that supports the pump bodies. Depending on the orientation of the adjustment member, when a user presses the pushbutton, the disk actuates the pump control members to a greater or lesser extent, thereby enabling a mixture to be dispensed with the desired relative proportions of the substances taken from the reservoirs associated with the pumps. Such a device is not designed to use standard pumps and is also of structure that is relatively complex.

SUMMARY OF THE INVENTION

Exemplary embodiments of the invention provide a dispenser device comprising a plurality of reservoirs for containing respective substances, a pump associated with each said reservoir, a pushbutton, at least one elastically-deformable transmission member associated with at least one of the control members, and at least one adjustment member for adjusting an end-of-stroke position of the displacement at least of the control member associated with the transmission member. Each said pump may be associated with a movable control member which, when actuated, causes the substance contained in the reservoir associated with the pump to be dispensed. Further, the at least one elastically-deformable transmission member may be disposed in such a manner as to transmit displacement of the pushbutton to the at least one control member in order to dispense substance(s).

In exemplary embodiments, the transmission member may deform when the associated control member reaches its end-of-stroke position, for example, as imposed by the adjustment member, before the other control member reaches its end-of-stroke position, thereby enabling the pushbutton to continue moving and driving the other control member.

In exemplary embodiments, the adjustment member may be made as one or more parts, such as multiple parts that are movable relative to one another.

By acting on an adjustment member, exemplary embodiments of the invention make it possible to vary the stroke through which at least one of the control members is displaced when the pushbutton is depressed. It is thus possible to measure out at least one of the substances in the dispensed mixture.

In exemplary embodiments, the device may include elastically-deformable transmission members disposed so that each of the transmission members transmits displacement of a pushbutton to an associated control member in order to dispense substance. Each elastically-deformable transmission member may be disposed in such a manner as to deform when the associated control member reaches the end-of-stroke position, for example, imposed by an adjustment member, before the other control member so as to enable the pushbutton to continue moving and driving the other control member.

In exemplary embodiments, the device may include actuator members movable relative to a pushbutton and associated with respective control members. Each elastically-deformable transmission member may be disposed in such a manner as to be interposed between a surface of an associated actuator member and the pushbutton.

Each actuator member may comprise a rod slidable in a guide, such as a tubular guide, of the pushbutton. Further, the elastically-deformable member associated with the each actuator member may be disposed around the respective rod.

In exemplary embodiments, the actuator members may be connected together by an elastically-deformable coupling assembly. This may make the actuator members easier to manufacture and handle, particularly while the actuator members are being put into place on the device.

By way of example, the coupling assembly may comprise, for example, flexible arms connecting each of the actuator members to a central rod. The flexible arms may, for example, together form an S-shape when the coupling assembly is observed along the axis of the central rod.

In exemplary embodiments, the coupling assembly may include endpieces that are fixed to the pushbutton and through which substance delivered by each of the pumps can be delivered to the pushbutton.

In exemplary embodiments, the device may include flexible hoses through which substances delivered by the pumps can flow from the actuator members to housings that communicate with the endpieces.

In exemplary embodiments of the invention, the pumps may be standard pumps. For example, each control member may include a pump rod, such as, for example, a pump rod that having an internal channel through which substance delivered by the pump can be delivered.

In exemplary embodiments, each adjustment member may include an endpiece that is mounted at the end of the associated pump rod. The endpiece may be arranged to enable a flexible hose to be connected to convey the substance delivered by the pump to a dispenser orifice.

In exemplary embodiments, the elastically-deformable member may be a spring, such as a helical spring. The spring may bear at one end against the endpiece and at the other end against the corresponding tubular guide of the pushbutton.

In exemplary embodiments, the adjustment member may comprise a plurality of surfaces situated at different heights and against which the actuators members can come to bear when the associated control members have reached their respective end-of-stroke positions. The various heights may be selected in such a manner that the sum of the strokes over which the control members of the pumps travel remains constant regardless of the position of the adjustment member. For example, the various heights may be equal to the maximum stroke of a control member.

In exemplary embodiments, each of the plurality of surfaces may be defined by a top edge of a tongue.

In advantageous embodiments, the adjustment member may be a rotary member, that is, a member that includes at least one rotary part. In such embodiments, the tongues may be elastically deformable and may be arranged so as to deform elastically in contact with at least one control member during rotation of the adjustment member, so as to provide at least one hard point in the rotary travel of the adjustment member. Such a hard point may make it easier for a user to position the adjustment member in a position that corresponds to a determined mixture. In exemplary embodiments, the tongues may be arranged in such a manner that, in a position of the adjustment member corresponding to dispensing a given mixture, at least one control member is disposed between portions of two consecutive tongues which resist turning of the adjustment member or even prevent the adjustment member from turning.

In exemplary embodiments, each tongue may have a rounded portion in which a control member can be received when the tongue is in a position for adjusting the stroke of the control member.

In exemplary embodiments, bottom edges of the tongues may be situated substantially in a same plane. Each tongue may be arranged, for example, so that in a position for adjusting the stroke of the associated control member, the tongue comes to bear via its bottom edge against a bearing surface that is fixed relative to the corresponding pump body.

In exemplary embodiments, the adjustment member may have two coaxial rotary rings having tongues that enable the end of the stroke of at least one control member associated with the transmission member to be adjusted.

In exemplary embodiments, such rings may be interconnected via at least one gear. For example, in embodiments, the rings may be interconnected via two gears.

In exemplary embodiments, such tongues may have facing concave sides.

In exemplary embodiments, the pushbutton may include a top portion defining a bearing surface that enables a user to actuate the pushbutton. Further, in exemplary embodiments, the pushbutton may include an elastically-deformable skirt that extends the top portion downward, that is, away from the bearing surface.

In exemplary embodiments, the device may include an outlet orifice provided with a check valve, such as an elastomer check valve.

In exemplary embodiments, the device may include a base portion on which the pumps are mounted and relative to which the pushbutton is movable. Such a base portion may include at least one relief portion on which the adjustment member may be fastened, such as snap-fastened, such that the adjustment member is free to rotate or turn, while being substantially prevented from movement axially.

In exemplary embodiments, the base portion may include an outer skirt provided with at least one window that provides access to the adjustment member in order for a user to turn or rotate the adjustment member. In embodiments, the at least one window may comprise two opposite windows to facilitate rotation of the adjustment member.

In exemplary embodiments, the adjustment member may include a wall, such as a tubular wall, that is provided with reference marks, such as, for example, graduations, that are representative of different compositions of the mixture to be dispensed.

In exemplary embodiments, the reservoirs may comprise flasks that are assembled to the device.

In exemplary embodiments, such flasks may present a cross-section that is generally semicircular in shape.

In exemplary embodiments, the flasks may be assembled at least by a section member to which they are engaged.

By way of example, such a section member may include at least two walls that are at an angle to each other, forming an angle therebetween. A flask may be arranged to come to bear against the walls so as to be held against the section member.

In exemplary embodiments, one or more of the flasks may include two grooves in which such walls are received.

In exemplary embodiments, the section member may comprise an elongate central portion extending over at least a major part of a height of the flasks. Further, in exemplary embodiments, the section member may comprise a rib on each longitudinal side of the central portion. Such ribs may each form an outwardly-open V-shape when the section member is observed in cross-section.

In advantageous embodiments, the section member may be secured to the base portion. For example, the section member may be monolithically formed with the base portion, for example, by molding a plastics material.

In exemplary embodiments, the device may be used for packaging various cosmetic, pharmaceutical, household, or other substances. The device may preferably be used for packaging substances that are used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

In exemplary embodiments, one of the reservoirs may contain a sunscreen and the other reservoir may contain a moisturizer. In such embodiments, the adjustment member may be used to vary the proportion of the sunscreen in the mixture, and thus vary the resulting index of protection.

BRIEF DESCRIPTION OF THE DRAWINGS

The invention may be better understood on reading the following detailed description of non-limiting embodiments thereof, and on examining the accompanying drawings, in which.

DETAILED DESCRIPTION OF EXEMPLARY EMBODIMENTS

Figure 1:
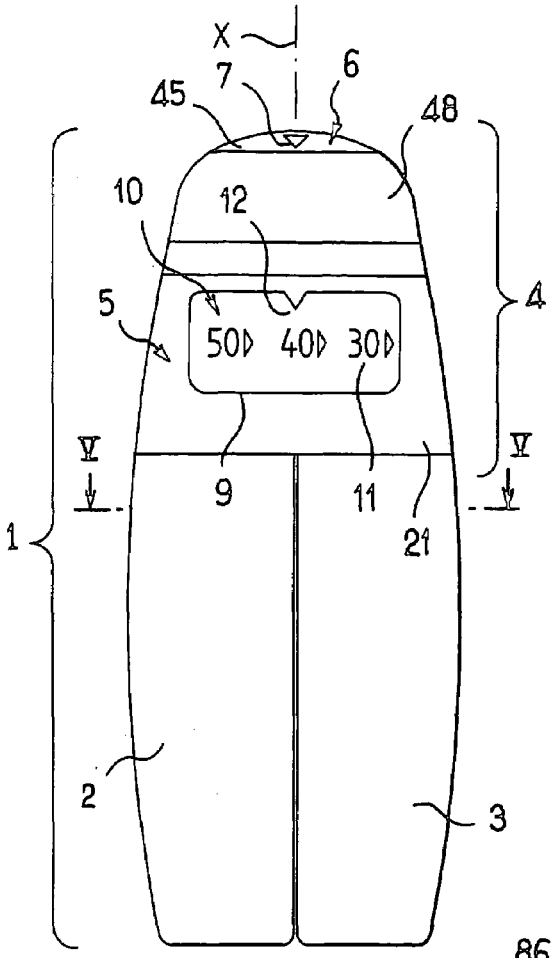
FIG. 1 is a diagrammatic elevation view of a first exemplary embodiment of a device in accordance with the invention.
Figure 2:
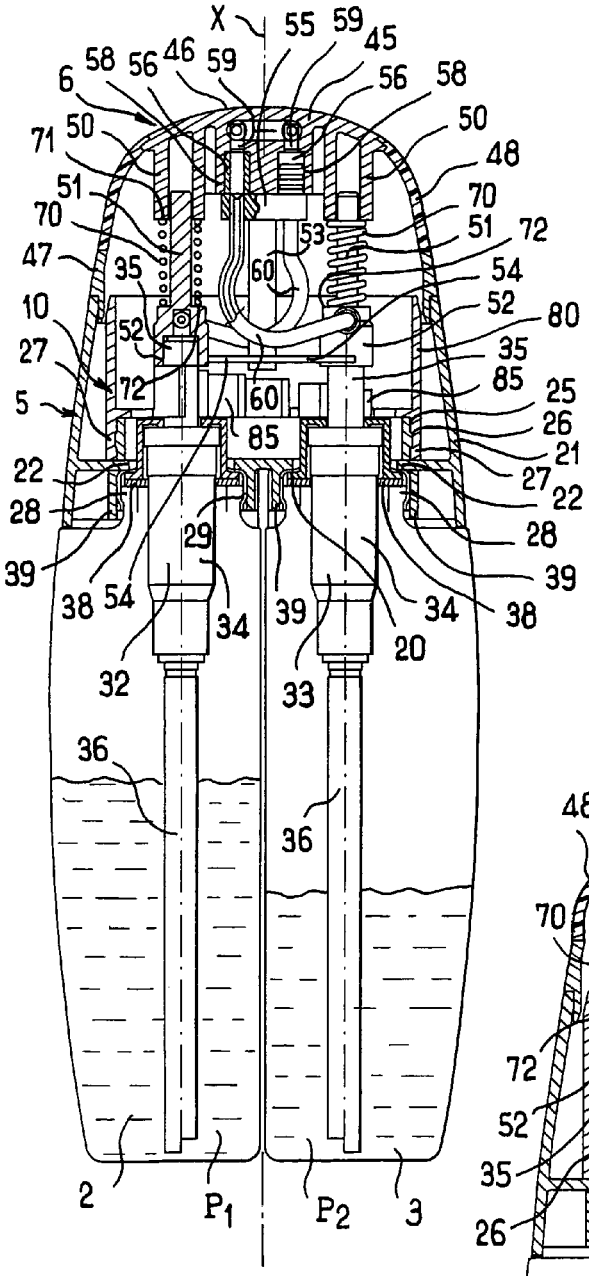
FIG. 2 is a diagrammatic and fragmentary axial section view of the device of FIG. 1 showing the pushbutton at rest.

A first exemplary embodiment of a device 1 is shown in FIGS. 1 and 2. The device 1 comprises a first flask 2 and a second flask 3. Each of the flasks 2, 3 respectively define a first reservoir containing a substance $P_1$, for example, a sunscreen, and a second reservoir containing a substance $P_2$, for example, a moisturizer. The device 1 further comprises a dispenser head 4 comprising a stationary base portion 5 and a pushbutton 6 that is movable relative to the base portion 5. In the first exemplary embodiment, the pushbutton 6 is provided with a single dispenser orifice fitted with a check valve 7. The check valve 7 may help prevent particles, such as sand, from entering the dispenser orifice. The check valve 7 may be made of elastomer, for example, and may be overmolded on the pushbutton 6.

In the first exemplary embodiment, the base portion 5 has two diametrically-opposite windows 9, only one of which can be seen in FIG. 1. The windows 9 may provide access to an adjustment member 10 for adjusting proportions of the substances $P_1$ and $P_2$ in the mixture that is dispensed.

The adjustment member 10 may be rotatable about the longitudinal axis X of the device 1, as shown in the first exemplary embodiment, and may have a series of graduations 11 that enable a user to select a determined mixture, for example, corresponding to a desired index of protection, by positioning a desired one of the graduations 11 under a mark 12 of the base portion 5.

With reference to FIG. 2, the base portion 5 may have a transverse wall 20 extending perpendicularly to the axis X and connected at its periphery to an outer skirt 21 in which the windows 9 are formed.

The transverse wall 20 may be provided with openings 22 that receive first and second pumps 32 and 33 associated with the first and second flasks 2 and 3, respectively.

In the first exemplary embodiment, each pump may be a standard pump. For example, as shown in FIG. 2, each pump 32, 33 comprises a body 34 and a control member 35. The control member 35 may comprise a hollow pump rod that presents an internal channel through which the substance is dispensed when the hollow pump rod is pushed into the pump body 34. In the first exemplary embodiment, the first and second pumps 32, 33 may be fitted with respective dip tubes 36 that may extend to or near a bottom of the corresponding reservoir.

The base portion 5 may also have an assembly skirt 25 provided with an annular bead 26 against which tabs 27 of the adjustment member 10 may be fastened, for example, snap-fastened, so that the adjustment member may turn or rotate about the axis X, preferably without substantial movement axially relative to the axis X.

Each pump 32, 33 may be fixed on a neck 28 of the corresponding flask 2, 3 by gripping a ring 29, such as a metal ring, with an annular sealing gasket 38 interposed between the respective pump body 34 and a top end face of the neck 28 as needed.

The first and second flasks 2 and 3 may be fixed at their top ends to the base portion 5, for example, as shown in the first exemplary embodiment, by snap-fastening the necks 28 against the tabs 39. The tabs 39 may have top ends that are connected to the transverse wall 20. It should be understood that the necks 28 may be fixed in some other way, for example, by screw fastening or by crimping.

The pushbutton 6 may have a top portion 45 that is relatively rigid and defines a bearing surface 46 for a user. The top portion 45 may be made of polypropylene, for example. The pushbutton 6 may also have a bottom portion 47, which may also be made out of a plastics material that is relatively rigid, for example, polypropylene, and an intermediate portion 48 that interconnects the top and bottom portions 45 and 47. The intermediate portion 48 may be made of a material that is elastically deformable, such as, for example, an elastomer material, such as styrene ethylene butadiene styrene (SEBS). The bottom portion 47 may be fixed to the top portion 5, for example, by snap-fastening.

The pushbutton 6 may have tubular guides 50, which may preferably be monolithically formed or molded out of the same plastics material as the top portion 45. The guides 50 may slidably receive respective rods 51 that are connected at a bottom end thereof to respective endpieces 52. Each of the endpieces 52 has the corresponding control member 35 operably connected therewith, for example, inserted therein. The rods 51 are associated with the first and second pumps 32 and 33, respectively.

Figure 3:
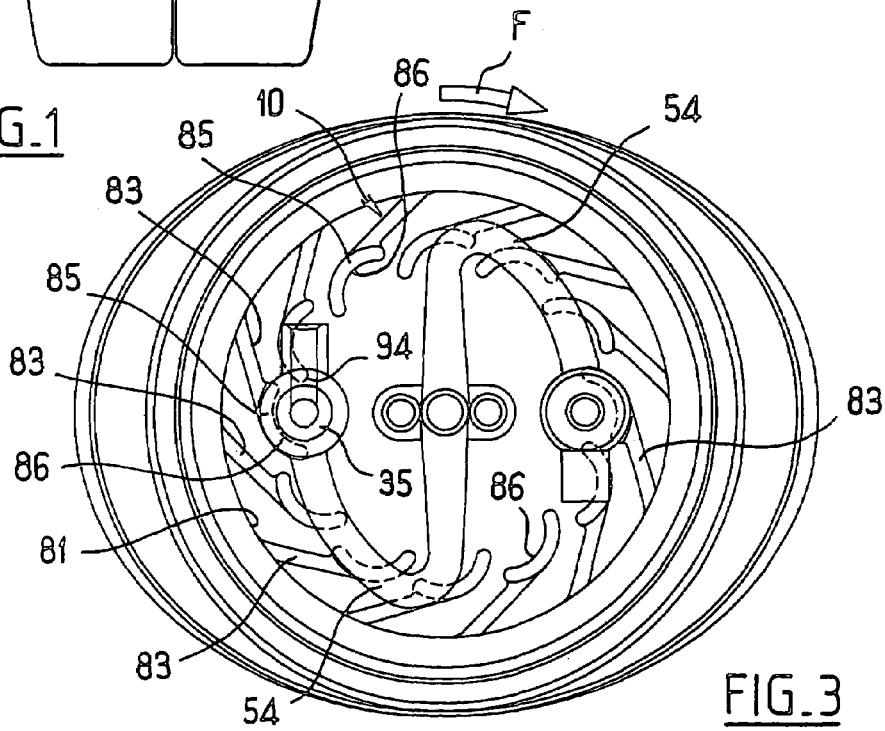
FIG. 3 is a diagrammatic and fragmentary plan view of the adjustment member of the device of FIG. 1.

The two endpieces 52 may be connected to each other by a coupling assembly comprising a central rod 53 and arms 54. Each of the arms 54 may connect one of the endpieces 52 to the central rod 53. When the coupling part is observed in plan view looking along the axis X, the arms 54 may, for example, be S-shaped, as can be seen in FIG. 3. A top of the central rod 53 is connected to an assembly portion 55 of the pushbutton 6. The assembly portion 55 may be provided with two endpieces 56 that are received in corresponding housings 58 of the top portion 45 of the pushbutton 6. The housings 58 may communicate with the dispenser orifice via respective channels 59. Flexible hoses 60, for example, made of polyethylene, may be employed to convey the substance delivered by each control member 35 to a corresponding endpiece 56. The hoses 60 may be inserted at one end in openings provided for this purpose in the endpieces 52. Such openings may have preferably axes perpendicular to the axes of the control members 35. The endpieces 56 of the coupling assembly may be inserted, for example, by force, into the corresponding housings 58 of the top portion 45 of the pushbutton 6, or otherwise operably coupled thereto.

Springs 70, such as helical springs as shown in the first exemplary embodiment, may be disposed on the respective rods 51 in compression, having top ends thereof bearing against bottom edges 71 of the tubular guides 50 and having bottom ends thereof bearing against shoulders 72, whereby each of the endpieces 52 is connected to the corresponding rod 51. Each spring 70 may be employed to transform displacement of the top portion 45 of the pushbutton 6 into displacement of the endpieces 52, which act as actuator members of the corresponding control members 35. The springs 70 may be sufficiently stiff to ensure that depressing the pushbutton 6 results in the control members 35 being displaced.

The adjustment member 10 may preferably have a circularly cylindrical wall 80 about the axis X, as shown in the first exemplary embodiment, with a radially inner surface 81 thereof having a plurality of tongues 83 connected thereto, as shown in FIG. 3. The adjustment member 10 may be made, for example, out of a deformable material, such as polyacetal copolymer (POM-C). The various coupling pieces 51, 52, 53, 54 may also be made out of the same material. It is also possible to use other materials, such as, for example, polypropylene, for these various elements.

The tongues 83 may extend radially inward in an oblique manner, for example, so as to be inclined in the same circumferential direction. At ends thereof, the tongues may have respective rounded portions 85, each with a concave side 86 facing inward, and each arranged in such a manner as to be capable, in a given position of the adjustment member 10, of coming substantially to overlap a portion of the periphery of one of the control members 35, as illustrated in FIG. 3.

Two diametrically-opposite tongues 83 may come to bear simultaneously against the respective control members 35, or at least to occupy positions in the vicinity thereof, so as to limit the extent to which the control members 35 are depressed when the pushbutton 6 is depressed.

The various tongues 83 are of heights that vary from one tongue to another such that top surfaces 90 of the tongues 83 do not all lie in the same plane perpendicular to the axis X.

In the first exemplary embodiment, bottom surfaces 91 of the tongues 83 may all lie in a single plane.

Figure 4:
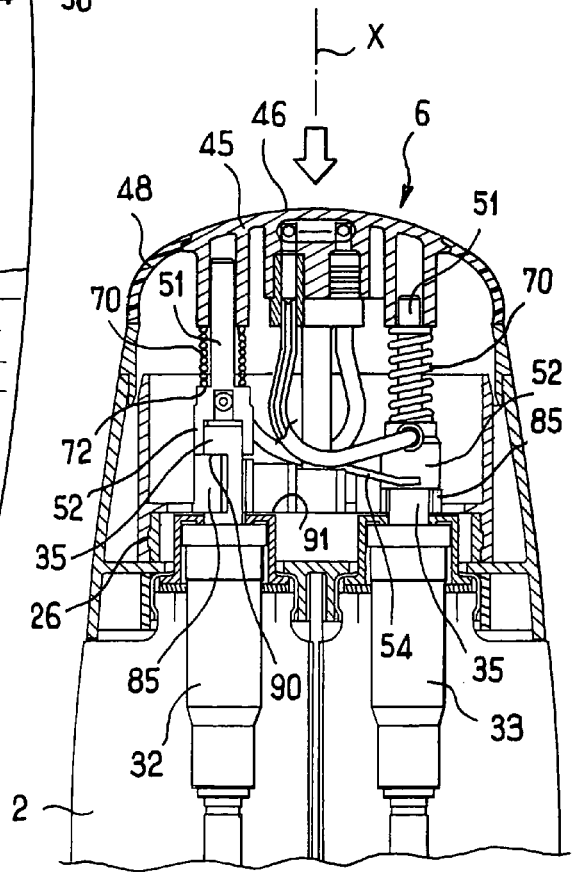
FIG. 4 is a diagrammatic and fragmentary axial section view of the device of FIG. 1 showing the pushbutton depressed to dispense substance.

Depending on the height of the tongue 83 associated with a respective control member 35, the endpiece 52 may entrain the control member 35 to a greater or lesser extent until the bottom end of the endpiece 52 comes into abutment against the top surface 90 of rounded portion 85 of the tongue 83, as illustrated in FIG. 4.

Each tongue 83 associated with one of the control members 53 may thus bear via its bottom surface 91 against the pump body 34.

When the adjustment member 10 is turned in the direction of arrow F, shown in FIG. 3, the tongues 83 may deform elastically so as to go past the control members 35, with an end 94 of each tongue 83 that has just gone past one of the control members 35 remaining close to that control member 35 thereafter. In a determined adjustment position, each control member 35 may thus be disposed between the rounded portion 85 of one 83 and the end 94 of the adjacent tongue 83, given the direction of rotation of the adjustment member 10, thereby holding the adjustment member 10 in the corresponding position.

In the first exemplary embodiment, the tongues 83 may be of heights that increase for the first several tongues, such as seven, on moving in the direction of arrow F, and then of decreasing heights for the next several tongues, such as five. The tongues 83 may, for example, limit the stroke of a control member 35 to desired values, such as: 0 millimeters (mm); 0.65 mm; 1.3 mm; 1.95 mm; 2.6 mm; 3.25 mm; 6.5 mm; 5.85 mm; 5.20 mm; 4.5 mm; and 3.9 mm.

In the first exemplary embodiment, the adjustment member 10 may take up eleven different positions, for example, corresponding to various depression strokes (in mm) for the first and second pumps 32 and 33, such as:

| Position | Pump 32 | Pump 33 |
|---|---|---|
| 0 | 6.50 | 0.00 |
| 1 | 5.85 | 0.65 |
| 2 | 5.20 | 1.30 |
| 3 | 4.55 | 1.95 |
| 4 | 3.90 | 2.60 |
| 5 | 3.25 | 3.25 |
| 6 | 2.60 | 3.90 |
| 7 | 1.95 | 4.55 |
| 8 | 1.30 | 5.20 |

-continued

| Position | Pump 32 | Pump 33 |
|---|---|---|
| 9 | 0.65 | 5.85 |
| 10 | 0.00 | 6.50 |

Once the user has operated the adjustment member 10 to select desired relative proportions of the substances $P_1$ and $P_2$ in the mixture that is to be dispensed, the pushbutton 6 may be depressed, as illustrated in FIG. 4. The displacement of the pushbutton 6 is transmitted to the control members 35 by the springs 70. When the strokes set for the control members 35 are unequal, and when a higher tongue 83 prevents displacement of the corresponding endpiece 52, the spring 70 associated with this endpiece 52 may compress to allow the user to continue to depress the pushbutton 6 and allow the other control member 35 to continue moving downward until the corresponding endpiece 52 comes to bear against the associated tongue 83.

During depression of the pushbutton 6, the arms 54 may deform so as to accompany the displacements of the endpieces 52.

The first and second flasks 2 and 3 may be made in various ways, such as for example, by blow-molding or injection blow-molding. In embodiments, the first and second flasks 2 and 3 may preferably be identical.

Figure 5:
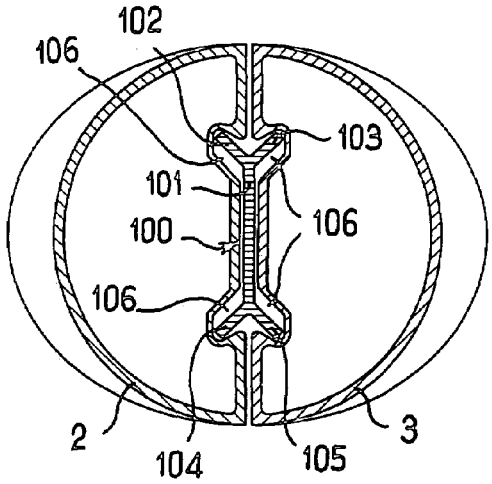
FIG. 5 is a diagrammatic cross-section on V—V of FIG. 1.

In addition to the necks 28 of the first and second flasks 2 and 3 being fixed to the base portion 5 of the dispenser head, the first and second flasks 2 and 3 may be held side by side by an elongate part 100, as shown in FIG. 5. The elongate part 100, in the first exemplary embodiment, may be in the form of a section member having a central portion 101 with a pair of walls 102, 103, 104, and 105 forming a V-shape running along each of its longitudinal sides.

The walls 102 and 104 may diverge and the first flask 2 associated with these walls may have longitudinal grooves 106 in which the walls 102 and 104 may be slidingly engaged so as to form a dovetail type connection. The second flask 3 may be held by the walls 103 and 105 in a similar manner.

The section member 100 may be advantageously monolithically formed by molding the same plastics material as the transverse wall 20 of the base portion 5.

To put the first and second flasks 2 and 3 into place, first and second flasks 2 and 3 may be slid along the corresponding walls in an upward direction until the corresponding neck 28 snap-fastens in the tabs 39 of the base portion 5, for example.

Figure 6:
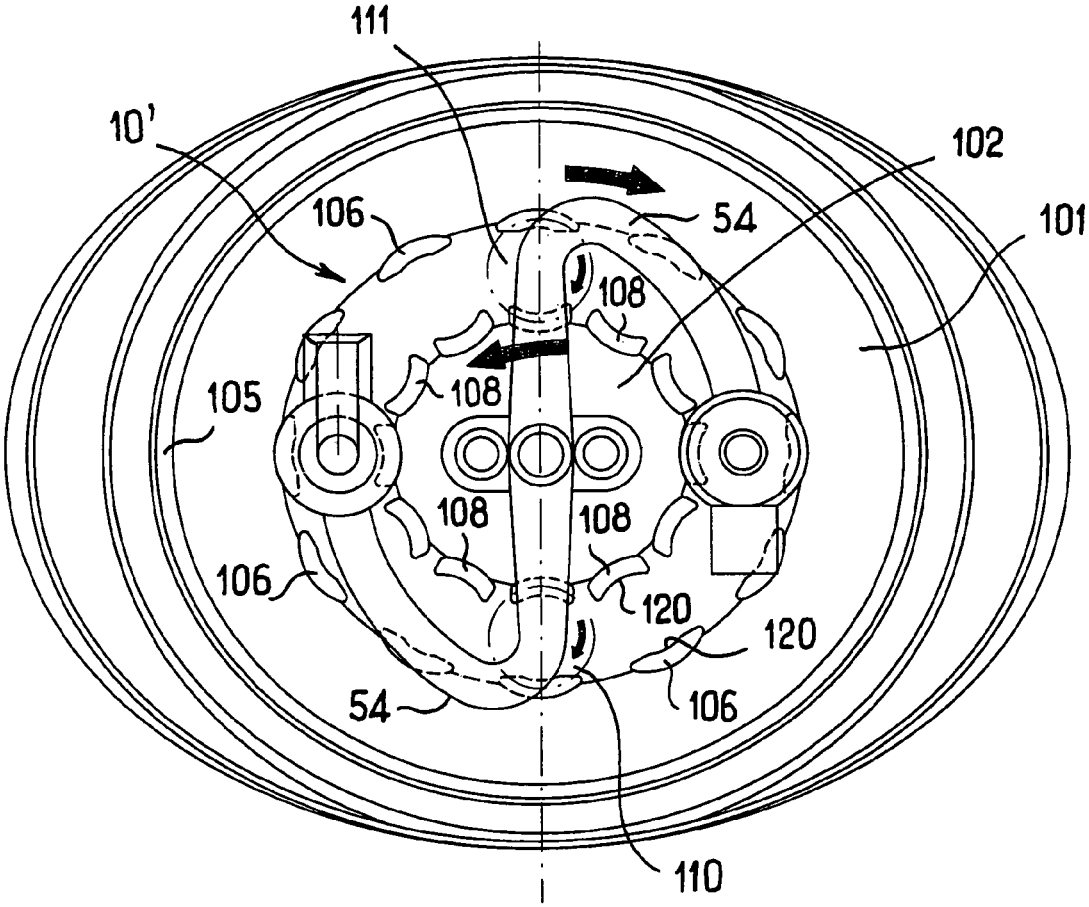
FIG. 6 is a diagrammatic and fragmentary plan view of an adjustment member of a second exemplary embodiment of a device in accordance with the invention.

FIG. 6 shows a second exemplary embodiment of a device in accordance with the invention in which the adjustment member 10 of the first exemplary embodiment is replaced by an adjustment member 10'. In the second exemplary embodiment, the adjustment member 10' comprises two rotary rings 101 and 102 that are coaxial about axis of rotation X.

The outer ring 101 maybe connected to a wall 105, which may be the same as the above-described wall 80. On an inner circumference of the outer ring 101, a plurality of first tongues 106 of different height may be carried. The first tongues 106 may be concave toward the axis X and may be arranged to occupy positions beneath the endpieces 52, similar to the tongues 83 described above.

At a periphery of the inner ring 102, a plurality of second tongues 108 may be arranged to come under the endpieces 52 on a side opposite from the first tongues 106.

Gears 110 and 111 that are arranged to turn about axes parallel to the axis X may mesh with sets of teeth (not shown) formed on the first and second rings 101 and 102 so as to transmit rotation from the first ring 101 to the second ring 102.

The second tongues 108 may be of heights that correspond to the heights of the first tongues 106 so that the first and second tongues 106 and 108 which lie under the same endpiece 52 for a given position of the first ring 101 have the same height. An advantage of having bearing surfaces for each of the endpieces 52 defined by tongues situated on either side of a given control member 35 is to prevent the control member 35 from being depressed beyond the intended stroke in a manner that is particularly reliable.

The first and second tongues 106 and 108 may have facing concave sides 120. Movement of the control members 35 past the concave sides 120 may be accompanied by a small amount of elastic deformation of the first and second tongues 106 and 108. This may make it easier to position the adjustment member 10' in a desired position.

Naturally, the invention is not limited to the embodiments described above and various modifications to the devices described above are fully contemplated.

For example, it is possible to use pumps that do not include pump rods but that have some other kind of control member. For example, pumps that include an elastically-deformable diaphragm, such as one having a bulging shape, may be employed where appropriate.

The springs 70 may be replaced by any other suitable elastically-deformable transmission members. For example, one or more blocks of foam, flexible tabs, or one or more bridges of elastomer material may be used.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

For example, while the exemplary embodiments described above include two reservoirs, it is to be understood that additional reservoirs may be used as desired, for example, to dispense additional substances. In such embodiments, additional corresponding parts may be employed as needed. The same applies to other parts of the device as described above with respect to the exemplary embodiments.

What is claimed is:

1. A dispenser device comprising:

a plurality of reservoirs each for containing a respective substance;

a pump associated with each said reservoir, and each pump being associated with a movable control member which, when actuated, causes a substance contained in the reservoir associated with the pump to be dispensed;

a pushbutton;

at least one elastically-deformable transmission member associated with at least one of the control members and configured in such a manner as to transmit displacement of the pushbutton to the at least one control member in order to dispense substance; and at least one adjustment member that adjusts an end-of-stroke position of the displacement at least of the control member associated with the at least one elastically deformable transmission member.

2. A device according to claim 1, wherein the at least one elastically deformable transmission member comprises at least two elastically-deformable transmission members, each configured to transmit displacement of the pushbutton to an associated one of the control members in order to dispense substance, each elastically-deformable transmission member being configured in such a manner as to deform when the associated one of the control members reaches the end-of-stroke position before the other of the control members, thereby enabling the pushbutton to continue moving and driving the other of the control members.

3. A device according to claim 1, further comprising actuator members movable relative to the pushbutton and associated respectively with the control members, each of the elastically-deformable transmission members being interposed between a surface of an associated said actuator member and the pushbutton.

4. A device according to claim 3, wherein each actuator member comprises a rod slidable in a tubular guide of the pushbutton, and wherein the elastically-deformable member associated with said actuator member is disposed around the rod.

5. A device according to claim 3, wherein the actuator members are connected together by an elastically-deformable coupling assembly.

6. A device according to claim 5, wherein the coupling assembly comprises flexible arms that connect each of the actuator members to a central rod.

7. A device according to claim 6, wherein said central rod has an axis, and wherein the flexible arms together form an S-shape when the coupling assembly is observed along the axis of the central rod.

8. A device according to claim 5, wherein the coupling assembly includes endpieces fixed to the pushbutton through which the substance delivered by each of the pumps can be delivered to the pushbutton.

9. A device according to claim 8, comprising flexible hoses through which substances delivered by the pumps can flow from the actuator members to housings that communicate with said endpieces.

10. A device according to claim 1, wherein each control member comprises a pump rod.

11. A device according to claim 3, wherein each control member comprises a pump rod.

12. A device according to claim 11, wherein an endpiece is configured to enable a flexible hose to be connected to convey substance delivered by the pump to a dispenser orifice.

13. A device according to claim 4, wherein each control member comprises a pump rod;

wherein each actuator member comprises an endpiece which is mounted at an end of the pump rod; and wherein the elastically-deformable element is a spring having one end bearing against the endpiece and an opposite end bearing against the tubular guide.

14. A device according to claim 13, wherein the spring comprises a helical spring.

15. A device according to claim 3, wherein the adjustment member has a plurality of surfaces situated at different heights and against which the actuator members come to bear when the associated control members reach the respective end-of-stroke positions.

16. A device according to claim 15, wherein the adjustment member comprises a plurality of tongues, and wherein each of said surfaces is formed by a top edge of a said tongue.

17. A device according to claim 16, wherein the adjustment member is rotary, and wherein said tongues are elastically deformable and configured to deform elastically in contact with at least one of the control members during rotation of the adjustment member.

18. A device according to claim 17, wherein the tongues are configured in such a manner that in a position of the adjustment member corresponding to dispensing a mixture, at least one of the control members is situated between portions of two consecutive said tongues which inhibit the adjustment member from rotating.

19. A device according to claim 17, wherein each said tongue comprises a rounded portion in which a control member is received when the tongue is in a position for adjusting the stroke of the control member.

20. A device according to claim 16, wherein said tongues are of different heights, and wherein the tongues have bottom edges that are situated substantially in the same plane.

21. A device according to claim 16, wherein each tongue has a bottom edge, and wherein each tongue, in a position for adjusting the stroke of the associated control member, bears against a surface, said surface being fixed relative to a body of the corresponding pump.

22. A device according to claim 1, further comprising a base portion having an outer skirt provided with at least one window that provides access to the adjustment member in order to rotate the adjustment member.

23. A device according to claim 22, wherein the at least one window comprises two opposite windows.

24. A device according to claim 22, wherein the adjustment member has a tubular wall provided with reference marks.

25. A device according to claim 1, wherein the pushbutton comprises:

a top portion defining a bearing surface that enables a user to actuate the pushbutton; and an elastically-deformable skirt that extends from said top portion away from the bearing surface.

26. A device according to claim 1, further comprising an outlet orifice provided with a check valve.

27. A device according to claim 1, wherein the check valve is made of elastomer.

28. A device according to claim 1, further comprising a base portion on which the pumps are mounted and relative to which the pushbutton is movable.

29. A device according to claim 28, wherein the base portion comprises at least one relief portion against which the adjustment member is snap-fastened such that the adjustment member is free to rotate while being substantially prevented from moving axially.

30. A device according to claim 1, wherein the adjustment member comprises two coaxial rotary rings having tongues for adjusting the end-of-stroke position of at least the control member associated with the transmission member.

31. A device according to claim 30, wherein the rings are interconnected by at least one gear.

32. A device according to claim 30, wherein the tongues comprise facing concave surfaces.

33. A device according to claim 1, wherein the reservoirs comprise flasks that are assembled to the device.

34. A device according to claim 33, wherein each of said flasks has a cross-section that is substantially semicircular in shape.

35. A device according to claim 33, wherein the flasks are assembled to the device via a section member on which the flasks are engaged.

36. A device according to claim 35, wherein the section member has at least two walls forming an angle therebetween, and wherein at least one of the flasks is configured to bear against said walls.

37. A device according to claim 36, wherein at least one said flask has two grooves in which said walls engage.

38. A device according to claim 35, wherein the section member comprises a central portion of elongate shape extending over at least a major part of a height of the flasks, with two pairs of ribs extending from respective longitudinal sides of said central portion, each pair of ribs forming an outwardly-open V-shape when the section member is observed in cross-section.

39. A device according to claim 28, wherein the reservoirs comprise flasks that are assembled to the device, and wherein the flasks are engaged on a section member which is secured to the base portion.

40. A device according to claim 39, wherein the section member is monolithically formed with the base portion by molding a plastics material.

41. A device according to claim 1, wherein at least one of the reservoirs contains a sunscreen.

42. A device according to claim 41, wherein at least one other of the reservoirs contains a moisturizer.

43. A device according to claim 10, wherein the pump rod has an internal channel through which substance delivered by the corresponding pump can be dispensed.

44. A device according to claim 11, wherein the pump rod has an internal channel through which substance delivered by the corresponding pump can be dispensed.

45. A device according to claim 13, wherein the pump rod has an internal channel through which substance delivered by the corresponding pump can be dispensed.

46. A device according to claim 15, wherein the different heights are selected in such a manner that the sum of the strokes over which the control members travel is constant for all positions of the adjustment member.

47. A device according to claim 24, wherein the reference marks comprise graduations representative of different compositions to be dispensed.

48. A device according to claim 1, wherein the plurality of reservoirs comprises two reservoirs.

49. A method of simultaneously dispensing a plurality of substances comprising:

providing the dispenser device of claim 1;

providing a first substance in a first said reservoir;

providing a second substance in a second said reservoir;

adjusting the end-of-stroke position of the displacement at least of the control member associated with the at least one transmission member;

displacing the pushbutton and transmitting the displacement of the pushbutton to the control members of the pumps to dispense the first and second substances in a desired proportion.

50. The method of claim 49, wherein the first substance comprises a sunscreen.

51. The method of claim 50, wherein the second substance comprises a moisturizer.

* * * * *